US005984526A

United States Patent [19]

Imai et al.

[11] Patent Number: 5,984,526

[45] Date of Patent: Nov. 16, 1999

[54] BEARING APPARATUS

[76] Inventors: Tooru Imai; Akira Imai; Yutaka Imai, all of 1-24, Miyado 1-chome, Asaka-shi, Saitama, Japan

[21] Appl. No.: 09/089,654

[22] Filed: Jun. 3, 1998

[30] Foreign Application Priority Data

Jun. 5, 1997 [JP] Japan ..... 9-147610

[51] Int. Cl.[6] ..... F16C 17/02

[52] U.S. Cl. ..... 384/129; 384/255; 384/901

[58] Field of Search ..... 384/129, 255, 384/901, 192, 261

[56] References Cited

U.S. PATENT DOCUMENTS 5,678,299 10/1997 Mochizuki et al. .
5,678,931 10/1997 Woodrow et al. .
5,683,185 11/1997 Buse .
5,713,731 2/1998 Utter et al. .

FOREIGN PATENT DOCUMENTS 50-22310 3/1975 Japan .
52-111007 9/1977 Japan .
54-14008 2/1979 Japan .
5-280479 10/1993 Japan .
7-224776 8/1995 Japan .

*Primary Examiner*—Lenard A. Footland
*Attorney, Agent, or Firm*—McCormick, Paulding & Huber

[57] ABSTRACT

A rotor 16 rotatably installed on a casing 10 is in contact with a container hole 11 of the casing 10, and the rotor 16 is equipped with a rotating shaft 17 which rotates around a rotation center $O_2$ at a position deviated from a reference axis $O_0$ of a container chamber by a distance E. An eccentric bearing 25 is rotatably attached to the casing 10, and has a rotation center $O_1$ at a position deviated from both the rotation center $O_2$ and the reference axis $O_0$ by a predetermined distance. The eccentric bearing 25 rotates in accordance with rotation of the rotating shaft 17, and the rotor 16 is thereby brought into contact with the sliding contact portion 11*a* with a predetermined stress. As a result, it is possible to set large tolerances of processing precision of components of a driving device having a rotating member and a casing containing the rotating member.

8 Claims, 5 Drawing Sheets

BEARING APPARATUS

BACKGROUND OF THE INVENTION

1. Field of the Invention

The present invention relates to a bearing apparatus which supports a rotating shaft for rotatably supporting a rotating member assembled in a casing.

2. Related Art Statement

A hydraulic pump is used to convert a rotational motion of an electric motor or the like into kinetic energy of a non-compressible fluid such as an oil, and a compressor is used to convert the motion into kinetic energy of a compressible fluid such as air.

Hydraulic pumps include a gear pump, a vane pump, a screw pump, and a radial piston pump. The gear pump is a pump which obtains a pumping effect by a movement of a volume surrounded by a tooth space and a casing and is divided into a circumscribed type and an inscribed type. A vane pump is a pump which obtains a pumping effect by a change of a volume defined between a plurality of vanes inserted in a groove of a rotor. A screw pump is a pump which moves forwards a fluid in an axial direction by rotating a shaft where a threaded surface is formed, and is divided into a one-shaft type, a two-shaft type, and a three-shaft type. An IMO type pump is known as a screw pump of the three-shaft type.

A piston pump is a pump of a type which suctions and discharges a liquid with use of a volume change caused by a reciprocal movement of a piston. An axial piston pump is equipped with a piston parallel to the axis of a cylinder block, while a radial piston pump is equipped with a piston arranged radially in a cylinder block.

As a compressor which use a compressible fluid such as air to obtain a compressed fluid of a predetermined value or higher, there is a compressor of a volume type. This type of compressor is divided into a rotation type which pressurizes a gas suctioned by rotation of a rotor in a casing like the vane type and the screw type of a hydraulic pump, and a reciprocation type which pressurizes a gas by a movement of a piston reciprocating in a cylinder. These hydraulic driving devices and air-pressure driving devices are described in, for example, KABUSHIKIKAISHA OHM-SHA, "SHINBAN YUATSU-BINRAN", pages from 204 and pages 445 to 451, Feb. 25, 1989.

A fluid-pressure driving device such as a pump or a compressor as described above have a rotor or a rotating member which is rotated and driven by a drive shaft connected to the motor. The rotor is brought into contact with a sliding surface such as a inner circumferential surface of the casing. If an unnecessarily excessive clearance is created between the casing and the rotor, the device cannot maintain its performance. If the rotor comes into collision with the inner surface, the device stops operating. Therefore, it is important to set a contact pressure and a pressure between the rotor and the inner surface to optimum values.

Thus, to manufacture a driving device such as a pump, the outer diameter of a rotor and the size of an inner circumferential surface of a casing must be processed to have predetermined precision, and how precisely respective components constituting the driving device can be processed is a significant point in view of maintaining performance of the device. It is therefore necessary to strictly manage tolerances of processing precision of respective components, and hence, problems occur in that the manufacturing steps are complicated and the manufacturing costs are increased.

SUMMARY OF THE INVENTION

The present invention has an object of obtaining desired characteristics even when tolerances of processing precision of components in a driving device having a rotating member and a casing containing the rotating member.

A bearing apparatus according to the present invention comprises: a casing having a container chamber; a rotating member coming into contact with the casing, and rotatably installed in the container chamber; a rotating shaft attached to the rotating member and having a rotation center at a position deviated from a reference axis of the container chamber; and an eccentric bearing rotatably supporting the rotating shaft, rotatably installed on the casing, and having a rotation center at a position deviated from both of the rotation center of the rotating member and the reference axis, wherein the eccentric bearing is rotated together in association with rotation of the rotating shaft, and the rotating member thereby applies a pressure to the sliding surface to make a contact therebetween. The rotating member may be a rotor forming a pump or a compressor which pressurizes and discharges a fluid which has flowed into the container chamber.

Where the rotating member is a rotor forming a pump or a compressor, an eccentricity amount ($E_1$) between the reference axis and the rotation center of the eccentric bearing may be set to be smaller than an eccentricity amount ($E_2$) between the rotation center of the eccentric bearing and the rotating shaft, and an angle ($\angle O_0O_1O_2$) defined by a center ($O_0$) of the reference axis, the rotation center of the eccentric bearing, and a center ($O_2$) of the rotating shaft may be set to be smaller than 90°.

Further, an eccentricity amount (E) of the rotating shaft from the reference axis may consist of a combination of an eccentricity amount ($E_1$) between the reference axis and the rotation center of the eccentric bearing and an eccentricity amount ($E_2$) between the rotation center of the eccentric bearing and the rotating shaft, and may change in accordance with the rotation of the rotating shaft.

Also, the eccentric bearing may further be provided with a concentric bearing provided to be concentric with the rotating shaft, and the rotating shaft may be rotatably supported on the eccentric bearing through the concentric bearing.

In addition, the concentric bearing may be constructed by a sliding bearing such as bearing metal, or a rolling bearing such as a ball bearing or a needle bearing.

According to the present invention, since the eccentric bearing is rotated in association with the rotating shaft supported by the eccentric bearing, the rotating member and the casing can be in contact with each other at a predetermined position. It is therefore possible to enhance the tolerances of the size of the outer diameter of the rotating member and the size of the inner surface of the container hole to be in contact with the rotating member. Besides, at this contact position, the rotating member has a contact with an optimum stress so that leakage of fluid from the sliding surface can be prevented.

Accordingly, it is possible to set large tolerances and allow large errors for the rotating member and the container hole in a fluid pressure driving device of a type in which a rotating member slides on and has a contact with an inner circumferential surface of a container hole. As a result, manufacturing costs of the fluid pressure driving device can be reduced.

Also, a contact stress between a rotating member and a casing at a contact portion therebetween can be maintained at a predetermined value, so that seal ability and lubrication ability can be improved at the contact portion.

The above-described and other objects, and novel feature of the present invention will become apparent more fully from the description of the following specification in conjunction with the accompanying drawings.

DESCRIPTION OF THE PREFERRED EMBODIMENT

In the following, embodiments of the present invention will be explained in details with reference to the drawings.

Figure 1:
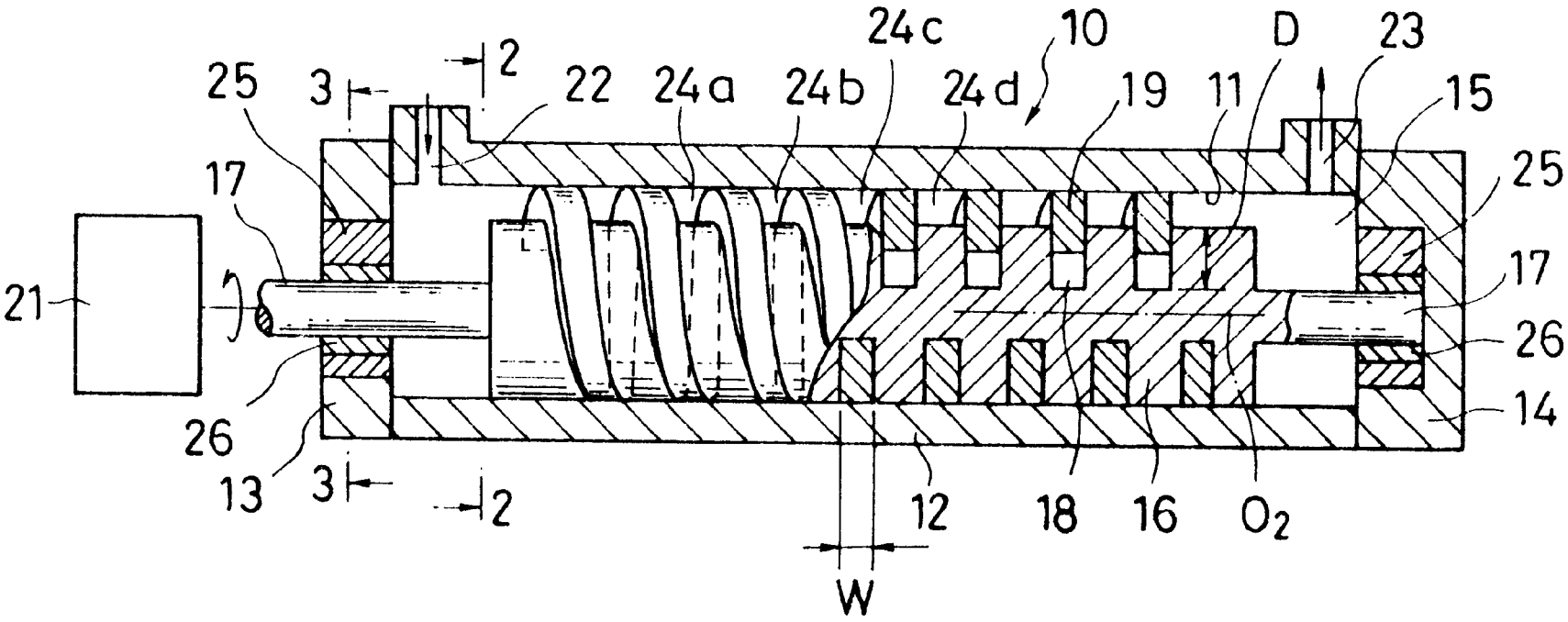
FIG. 1 is a longitudinal cross-sectional view showing a pump in which a bearing apparatus as an embodiment of the present invention.
Figure 2:
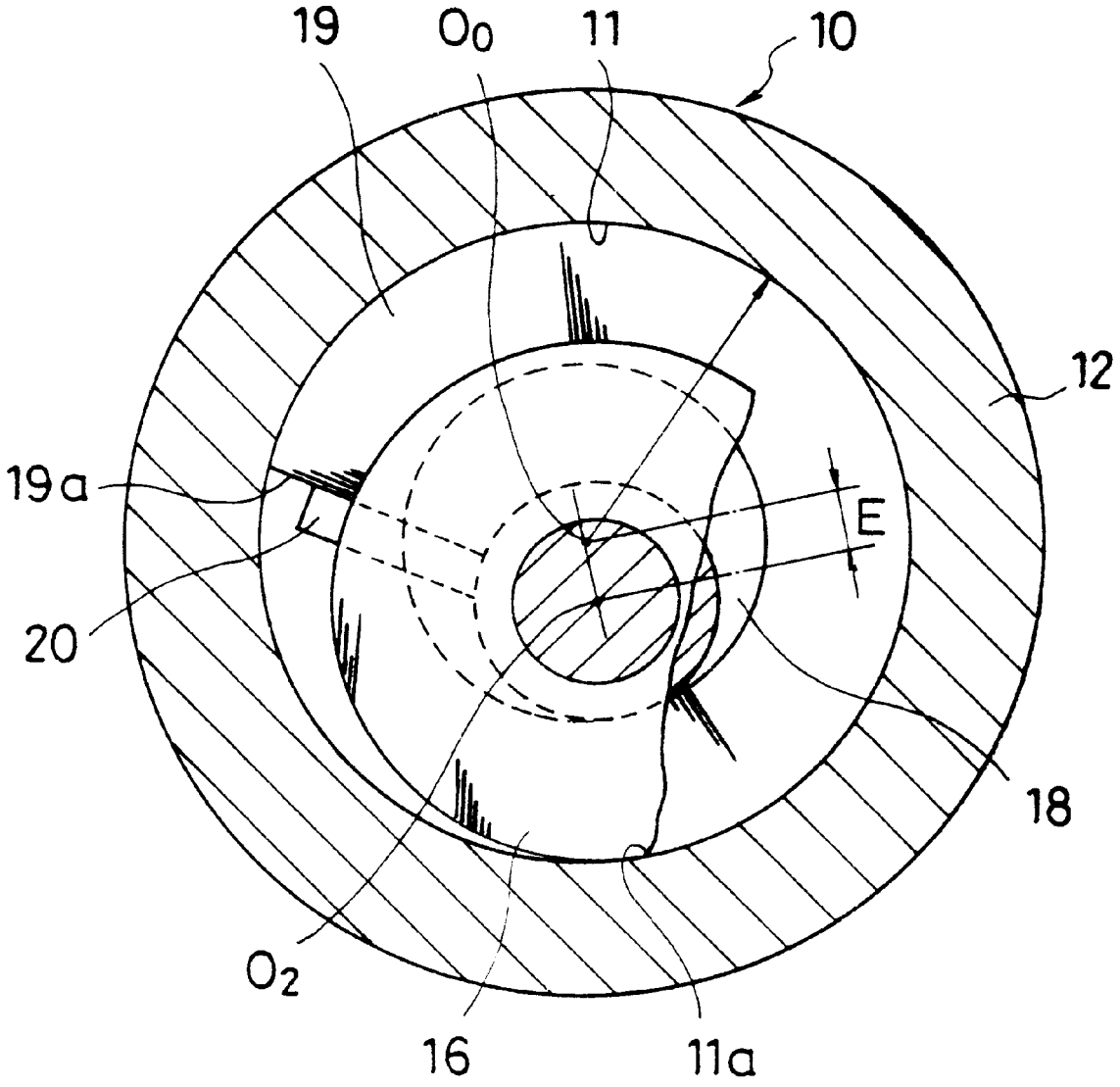
FIG. 2 is a cross-sectional view along a line 2—2 in FIG. 1.

FIG. 1 is a longitudinal cross-sectional view showing a pump incorporating a bearing apparatus as an embodiment of the present invention. FIG. 2 is a lateral cross-sectional view along a line 2—2 in FIG. 1. FIG. 3(A) is a lateral cross-sectional view along a line 3—3 in FIG. 1.

The pump has a cylindrical casing 10 forming a pump body as shown in FIGS. 1 and 2, and the casing 10 has a cylindrical portion 12 including a container hole 11 having a circular cross-section, and end plates 13 and 14 provided at both end portions of the cylindrical portion 12. The container hole 11 serves as a container chamber 15, and the center of the hole 11 is the reference axis $O_0$ of the container chamber 15. The cylindrical portion 12 and the end plates 13 and 14 are separately made. The casing 10 is formed by jointing them by screws or by assembling them by screw members.

In the chamber 15 of the casing 10, a columnar rotor 16, or rotating member having a circular outer circumferential surface is installed to be rotatable, and a rotating shaft 17 is attached to both end portions of the rotor 16. The center of the shaft 17 is a rotation center $O_2$ corresponding to the center of the rotor 16, and the rotation center $O_2$ is at a position deviated by a predetermined distance E from the reference axis $O_0$ as the center of the container chamber 15. In this manner, the outer circumferential surface of the rotor 16 slides on a sliding contact portion 11*a* of the hole 11, and the rotor 16 has a linear contact with the portion 11*a* over the entire length of in the lengthwise direction of the rotor 16.

A spiral groove 18 having a spiral shape or a helical shape is formed in the rotor 16, and the groove 18 is equipped with a blade, or a seal member 19 having a spiral shape corresponding to the groove 18, such that the member 19 is slidable in the radial direction. The seal member 19 having a spiral shape is made of an elastically deformable material such as hard rubber, plastics, metal, or the like, and has an elasticity toward the outside in the radial direction.

The seal member 19 has a width size in the radial direction, substantially corresponds to the depth D of the groove 18, and a thickness substantially corresponding to the width W of the groove 18. As shown in FIG. 2, an end surface 19*a* of the member 19 is in contact with a stopper 20 attached to the groove 18, as well as another end surface of the member 19.

Therefore, as the rotor 16 rotates, the member 19 rotates integrally with the rotor 16, with the member 19 kept in contact with the inner surface of the hole 11. The entire portion of the member 19 that has been rotated to the position of the portion 11*a* enters into the groove 18, and the portion of the member 19 that has a phase shifted by 180° from the former portion is pushed outwards most in the radial direction.

In FIG. 1, the shaft 17 in the left side is connected with an electric motor, and the rotor 16 is rotated and driven in a predetermined direction by the motor 21. An inlet port 22 for a fluid is formed at an end portion of the casing 10, and an outlet port 23 for the fluid is formed at another end portion thereof.

Since the rotor 16 is brought into contact with the hole 11, with the rotation center $O_2$ thereof being deviated from the reference axis $O_0$, a plurality of pressurizing chambers 24*a*, 24*b*, . . . are formed between the outer circumferential surface of the rotor 16 and the inner circumferential surface of the cylinder portion 12. The chambers 24*a*, 24*b*, . . . are enclosed by the outer surface of the rotor 16, the inner surface of the cylindrical portion 12, and the portion of the seal member 19 which is adjacent to the outer and inner circumferential surfaces. Each of the chambers 24*a*, 24*b*, . . . are enclosed at the portion of the sliding contact portion 11*a*, and the height of each chamber in the radial direction is gradually increased from the sliding contact portion 11*a* in both directions of the circumferential directions.

Therefore, a fluid which has flowed in through the inlet port 22 and entered into the chamber 24*a* shown in FIG. 1 is moved to the right side when the rotor 16 is rotated in the direction indicated by an arrow, because the fluid is shifted relatively in a direction opposite to the spiral surface of the seal member 19 partitioning the chamber 24*a* and the rotation direction of the rotor 16 as the rotor 16 is rotated in the direction indicated by the arrow. When the rotor is rotated by one turn, the fluid is positioned in the chamber 24*b*. Thus, the fluids in the pressurizing chambers are sequentially moved toward the outlet port 23.

Eccentric bearings 25 are rotatably equipped on the end plates 13 and 14 provided at both ends of the casing 10, and the shaft 17 is rotatably supported on the end plates 13 and 14 through concentric bearings 26 engaged with the eccentric bearings 25. Each of the end plates 13 and 14 is equipped with the bearing 25 and the bearing 26, the shaft 17 does not penetrate through the end plate 14 in order to increase the sealing characteristic, while the shaft 17 penetrates through the end plate 13 in order to make connection with the motor 21.

As shown in FIG. 3(A), a circular engagement hole 27 is formed in the end portion 13, with the center of the hole 27 situated at a position deviated from the reference axis $O_0$ as the center axis of the hole 11 by an eccentricity amount $E_1$, and the bearing 25 is rotatably installed in the engagement hole 27. Therefore, the bearing 25 is rotatable around the center of the hole 27 as the rotation center $O_1$.

A circular engagement hole 28 is formed in the bearing 25, with the center of the hole 28 situated at a position deviated from the rotation center $O_1$ by an eccentricity amount $E_2$, and the bearing 26 is rotatably engaged in the hole 28. The bearing 26 has an outer circumferential surface in contact with the hole 28, and an engagement hole 29 for rotatably supporting the shaft 17. The center of the outer surface corresponds to the center of the hole 29, and this center of them is the rotation center $O_2$. Therefore, the rotation center $O_1$ is deviated from the reference axis $O_0$ and the rotation center $O_2$ by a predetermined distance.

FIG. 3(B) is a view showing an enlarged eccentric state between the reference axis $O_0$, the rotation center $O_1$, and the rotation center $O_2$. The rotation center $O_2$ of the rotor 16 and the axis 17 is deviated from the center of the hole 11, or the reference axis $O_0$ by a combination eccentricity amount E. If the outer surface of the rotor 16 does not have a contact with the inner surface of the hole 11, the maximum value of the combination eccentricity amount E is $O_0O_1+O_1O_2$. In addition, the minimum value thereof is $O_0O_1-O_1O_2$, and the combination eccentricity amount E falls in the following range.

$$O_0O_1-O_1O_2 \leqq E \leqq O_0O_1+O_1O_2$$

Figure 3:
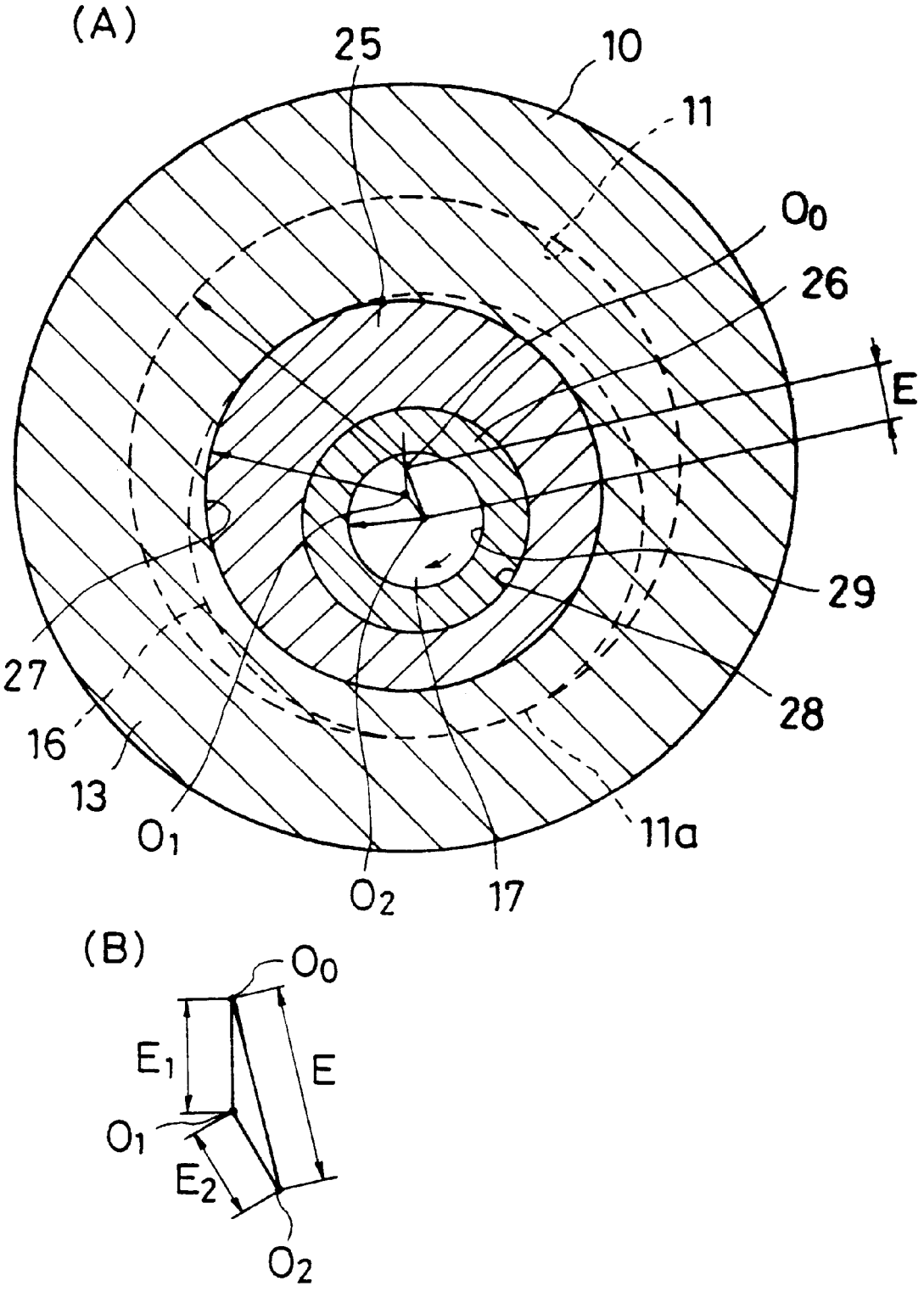
FIG. 3(A) is a cross-sectional view along a line 3—3 in FIG. 1.
FIG. 3(B) is an enlarged view explaining an eccentricity amount in FIG. 3(A)
Figure 4:
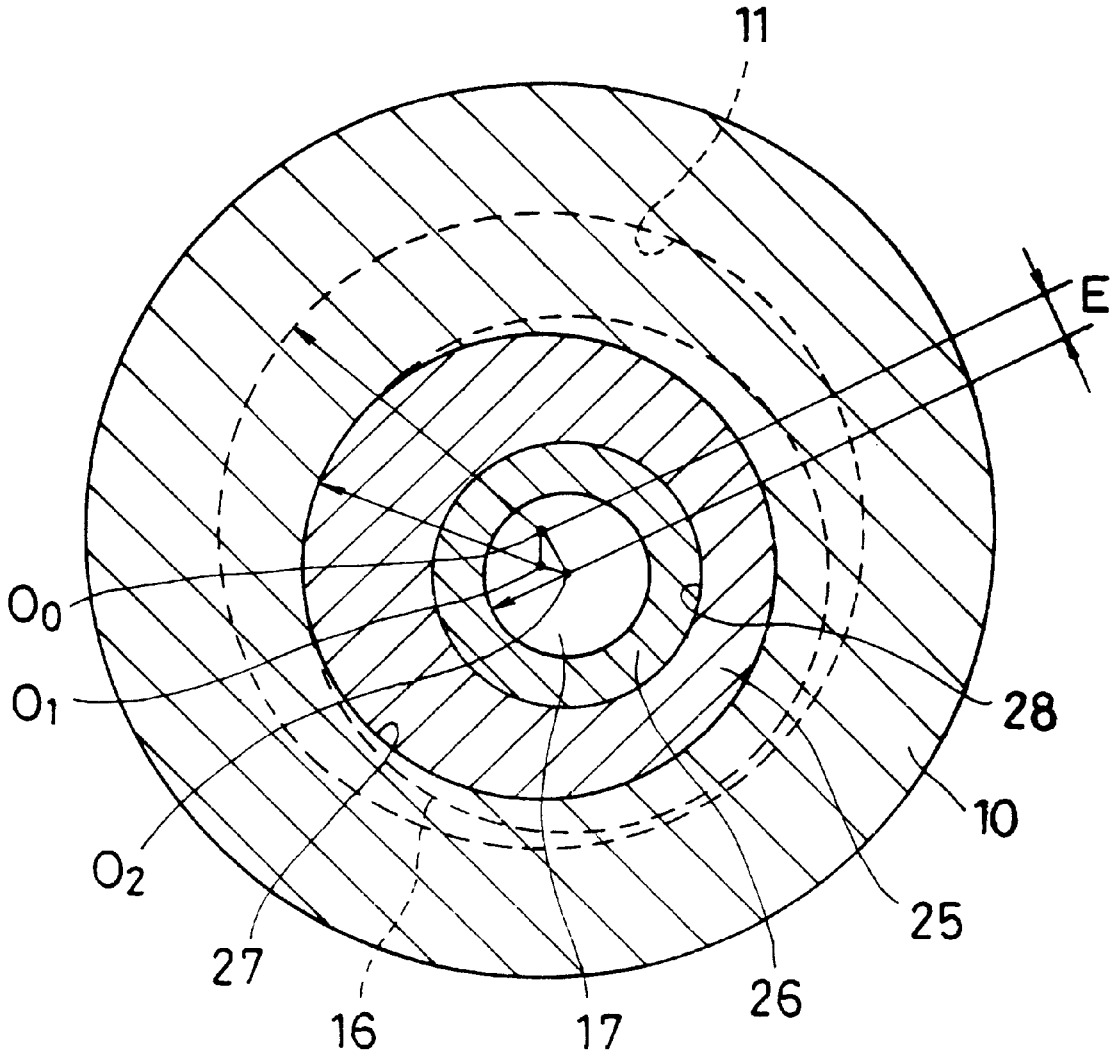
FIG. 4 is a cross-sectional view showing the same part as shown in FIG. 3(A), where an outer circumferential surface of a rotating member is distant from an inner circumferential surface of a container hole of a casing.

Therefore, as shown in FIG. 3(A), if the bearing 25 is rotated in the counter-clockwise direction in FIG. 3 from a state in which the outer surface of the rotor 16 is in contact with the hole 11, the outer surface of the rotor 16 is apart from the hole 11, as shown in FIG. 4. As shown in FIG. 3(A), the combination eccentricity amount E is set to be a value smaller than the maximum value when the outer surface is in contact with the container hole 11.

Since the eccentricity amount can thus be changed, the rotor 16 and the hole 11 can always be kept in contact with a predetermined contact pressure or stress even if the processing error of the outer diameter of the rotor 16 and the processing error are large.

If the shaft 17 is rotated in the clockwise direction as indicated by an arrow in FIG. 3(A), the rotation torque of the shaft 17 is transmitted to the bearing 26, as a rotation torque in the same direction, by a friction, since the shaft 17 is in contact with the sleeve-like bearing 26. The bearing 26 then receives a rotation torque in a direction of rotation according to the shaft 17. Likewise, when the bearing 26 receives a rotation torque, the torque is transmitted to the bearing 25, and the bearing 25 is rotated in a direction in which the combination eccentricity amount E is increased. As a result of this, the rotation center $O_2$ is shifted in a direction in which the rotor 16 is brought into contact with the portion 11*a* of the inner surface of the hole 11, as the shaft 17 rotates.

Figure 5:
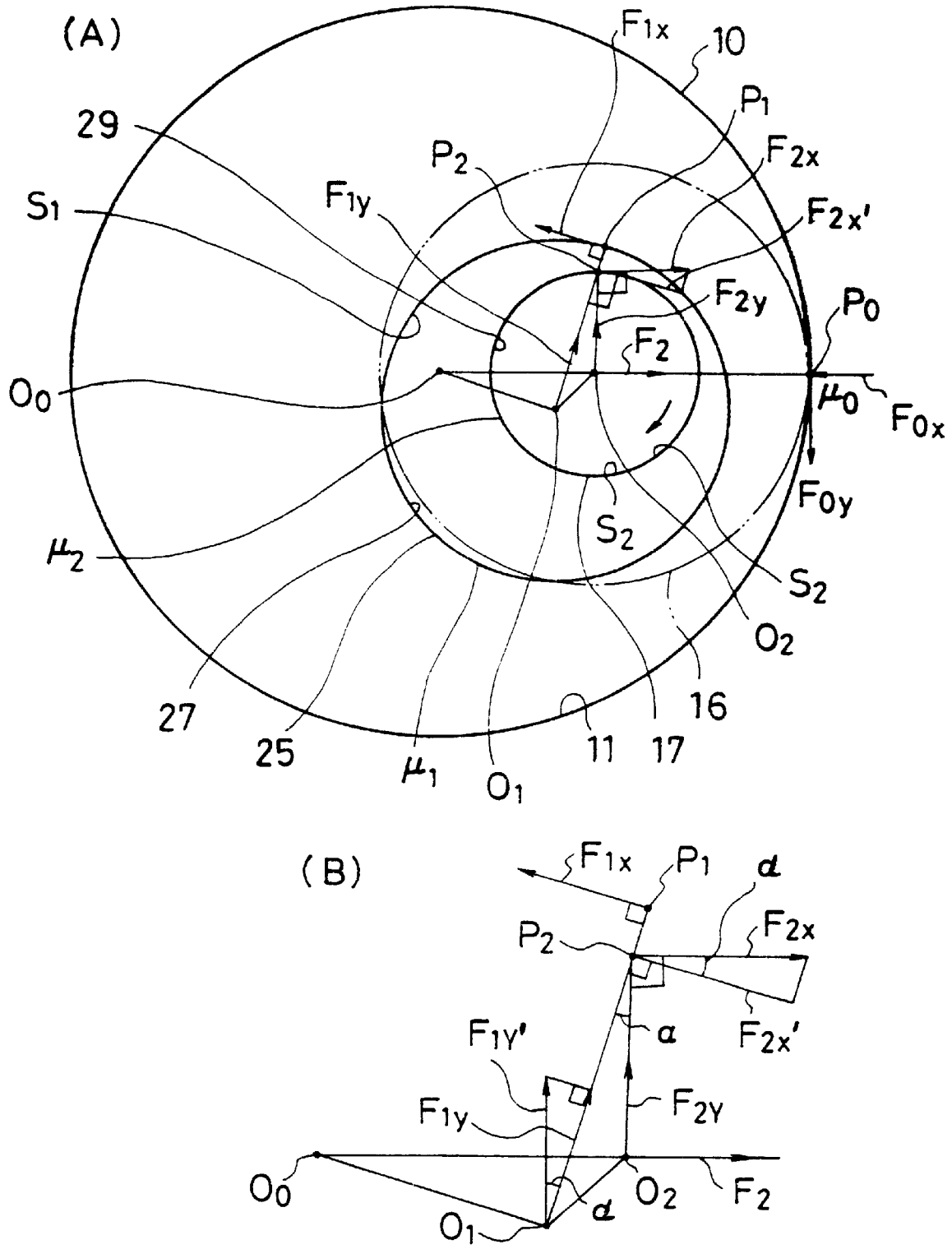
FIG. 5(A) is a view explaining a balance of forces when the rotating member slides in contact with the container hole.
FIG. 5(B) is an enlarged view of a main part of FIG. 5(A).

FIG. 5 is a view showing an acting state of contact forces between the shaft 17, the bearing 25, and the casing 10 when the outer surface of the rotor 16 comes into contact with the portion 11*a* of the inner surface of the hole 11 kept as a contact point $P_0$. The bearings 26 are omitted from this figure, and it is supposed that the friction coefficient between the outer surface and the contact point $P_0$ of the hole 11 is $\mu_0$, the friction coefficient between the hole 27 formed in the end plate is $\mu_1$, and the friction coefficient between the hole 29 of the bearing 25 and the shaft 17 is $\mu_2$. The reaction force when the rotor 16 is pressed against the inner surface of the hole 11 at the contact point $P_0$ is $F_{0X}$, and the reaction force in the circumferential direction is $F_{0Y}$.

A force $F_{2Y}$ in a direction opposite to the rotation direction is caused with respect to $O_2$ as a fulcrum by the sliding resistance of the rotor 16 at the contact point $P_0$, i.e., by the rotation resistance. This reaction force $F_{2Y}$ is obtained as follows, from the balance of moments around the point $P_0$.

$$F_{2Y}=(P_0O_0/O_0O_2)F_{0Y}=(P_0O_0/O_0O_2)\mu_0F_{0X}$$

By the friction (or friction coefficient $\mu_2$) at the point $P_2$, $F_{2X}=\mu_2F_{2Y}$ is generated on the surface $S_2$ of the bearing 25. The force $F_{2X}'$ of the $F_{2X}$ around the point $O_1$ is as follows.

$$F_{2X}'=F_{2X}\cos\alpha$$

$$F_{1X}=\mu_1Y=\mu_1F_{1Y}'\cos\alpha$$

These forces are balanced where $F_{1X}\cdot P_1O_1=F_{2X}'\cdot P_2O_1$ exists.

$$\mu_1F_{1Y}'\cos\alpha\cdot P_1O_1=F_{2X}\cdot\cos\alpha\cdot P_2O_1$$

$$\mu_1F_{1Y}'\cdot P_1O_1=\mu_2\cdot F_{2Y}\cdot P_2O_1$$

$$=\mu_2(P_0O_0/O_0O_2)\mu_0F_{0X}\cdot P_2O_1$$

$$F_{1Y}'=(\mu_0\mu_2/\mu_1)(P_0O_0\cdot P_2O_1/P_1O_1\cdot O_0O_2)F_{0X}$$

$F_2$ is a toggle force generated on the axis by $F_{1Y}'$, and the following is obtained where M is the magnification ratio thereof.

$$F_2=MF_{1Y}'$$

The balance is obtained by the following.

$$F_2=(\mu_0\mu_2/\mu_1)(P_0O_0\cdot P_2O_1/P_1O_1\cdot O_0O_2)F_{0X}$$

The bearing apparatus according to the present invention is not limited to application to a pump of the type shown in FIG. 1, but is applicable to various devices having a rotating member, such as a gear pump, a vane pump, and the like. For example, $F_{0X}$ is a reaction force from a tooth surface where the bearing apparatus is applied to a gear pump.

In the figures, the bearing 25 and the bearing 26 are sliding bearings formed of bearing metal. However, a needle bearing may be used as the bearing 26, or it is possible to use a ball bearing in which a plurality of balls are provided between inner and outer rings. Alternatively, a needle bearing or a ball bearing may be assembled between the bearing 25 and the end plate. Further, the present invention is applicable to a case where the eccentric direction itself is rotated, like an inscribed revolution axis type device (e.g., an inscribed gear pump) in which the shaft 17 is directly supported on the bearing 25 to make contact, without using the bearing 26.

In the figures, $\angle O_0O_1O_2$ is set to be larger than 90° under the condition where the outer surface of the rotor 16 is in contact with the portion 11*a* of the hole 11. However, contact may be made under the condition where the angle is smaller than 90°. If the angle is larger than 90°, the change rate of the eccentricity amount E tends to decrease, and therefore, the tightness of the contact of the outer circumferential surface of the rotor 16 on the portion 11*a* is increased, like the principle of the toggle, thereby hindering chattering of the rotor 16 caused by fluctuation of hydraulic lubrication at the portion 11*a*.

Meanwhile, if the angle is smaller than 90°, the change rate tends to increase. Therefore, the bearing apparatus is preferred as a bearing in a device of a type which a rotating member eccentrically rotates and revolves along the inner circumferential surface of a container hole, like an inscribed gear pump of an unbalanced type having an eccentric rotating member, or a pump or compressor of a type having a spiral seal member as shown in FIG. 1. Whether the angle should be greater or smaller than 90° and how large the angle should be are determined in consideration of sliding characteristics of the rotating member of a device and characteristics of the driving torque thereof.

In addition, the characteristics depending on the angle described above can be intensified or relaxed by adjusting the ratio in length between the eccentricity amount $E_1$ and the eccentricity amount $E_2$. That is, as the value of $E_2/E_1$ is decreased, the characteristic in the case where the angle is larger than 90° is intensified and the characteristic in the case where the angle is smaller than 90° is relaxed. Inversely, as the value of $E_2/E_1$ is increased, the characteristic in the case where the angle is larger than 90° is relaxed and the characteristic in the case where the angle is smaller than 90° is intensified.

That is, when the sliding contact portion of the rotating member has an unstable factor, or in a device of a type in which the rotating member revolves as described above, $\angle O_0O_1O_2$ is set to 90° or less or the ratio of $E_2/E_1$ is set to a large value. Meanwhile, when the sliding contact portion of the rotating member has a stable structure and an enough starting torque is obtained for driving, or in a driving device of an eccentric fixed rotation axis type, the angle is set to be larger than 90° or the ratio of $E_2/E_1$.

It is possible to manufacture a device having optimum sliding characteristics and output characteristics, by setting respective angles and eccentricity amounts described above in correspondence with output performance of a hydraulic device or an air-pressure device, in consideration of the characteristics as described above.

In the above, the invention made by the present inventor has been specifically explained. Needless to say, the present invention is not limited to the embodiments described above, but can be variously modified within a range not deviating from the subject matter of the invention.

The above explanation has been mainly made of a case where the invention made by the present inventor is applied to a pump having a spiral seal member included in the use field of the invention. The present invention, however, is not limited hitherto, but is applicable not only to a pump using a non-compressible fluid as an operation fluid, such as a gear pump, a vane pump, a radial piston pump, or the like, but also to a compressor having a similar basic structure and using a compressible fluid as an operation fluid, as long as the device is a driving device of such a type that has a rotating member whose rotation center is a position deviated from the reference axis of a container chamber formed in a casing or housing for containing to the rotating member by the casing.

What is claimed is:

1. A bearing apparatus comprising:

a casing having a container chamber;

a rotating member coming into contact with the casing, and rotatably installed in the container chamber;

a rotating shaft attached to the rotating member and having a rotation center at a position deviated from a reference axis of the container chamber; and an eccentric bearing rotatably supporting the rotating shaft, rotatably installed on the casing, and having a rotation center at a position deviated from both of the rotation center of the rotating member and the reference axis, wherein the eccentric bearing is rotated together in association with rotation of the rotating shaft, and the rotating member thereby applies a pressure to the sliding surface to make a contact therebetween.

2. A bearing apparatus according to claim 1, wherein the rotating member is a rotor forming a pump or a compressor which pressurizes and discharges a fluid which has flowed into the container chamber.

3. A bearing apparatus according to claim 2, wherein an eccentricity amount ($E_1$) between the reference axis and the rotation center of the eccentric bearing is set to be smaller than an eccentricity amount ($E_2$) between the rotation center of the eccentric bearing and the rotating shaft.

4. A bearing apparatus according to claim 2, wherein an angle ($\angle O_0O_1O_2$) defined by a center ($O_0$) of the reference axis, the rotation center of the eccentric bearing, and a center ($O_2$) of the rotating shaft is set to be smaller than 90°.

5. A bearing apparatus according to claim 1, wherein an eccentricity amount (E) of the rotating shaft from the reference axis consists of a combination of an eccentricity amount ($E_1$) between the reference axis and the rotation center of the eccentric bearing and an eccentricity amount ($E_2$) between the rotation center of the eccentric bearing and the rotating shaft, and changes in accordance with the rotation of the rotating shaft.

6. A bearing apparatus according to claim 1, wherein the eccentric bearing further has a concentric bearing provided to be concentric with the rotating shaft, and the rotating shaft is rotatably supported on the eccentric bearing through the concentric bearing.

7. A bearing apparatus according to claim 6, wherein the concentric bearing is constructed by a sliding bearing.

8. A bearing apparatus according to claim 6, wherein the concentric bearing is constructed by a rolling bearing.

* * * * *